United States Patent [19]

Thomas et al.

[11] 4,257,990

[45] Mar. 24, 1981

[54] REFRACTORY MATERIALS

[75] Inventors: William O. Thomas; Robin Hill, both of Port Talbot, Wales

[73] Assignee: Goricon Metallurgical Services Limited, Bridgend, Wales

[21] Appl. No.: 883,903

[22] Filed: Mar. 6, 1978

[51] Int. Cl.[3] ..... F27D 1/16

[52] U.S. Cl. ..... 264/36; 75/27; 264/30

[58] Field of Search ..... 264/30, 36; 75/27

[56] References Cited

U.S. PATENT DOCUMENTS

| | | | |
|---|---|---|---|
| 2,424,825 | 7/1947 | Hogan | 264/30 |
| 2,713,787 | 7/1955 | Rose | 264/30 X |
| 3,086,876 | 4/1963 | Griggs | 264/30 X |
| 3,192,080 | 6/1965 | Cooper | 75/27 X |

FOREIGN PATENT DOCUMENTS

| | | | |
|---|---|---|---|
| 600898 | 12/1959 | Italy | 264/30 |
| 260829 | 9/1970 | U.S.S.R. | 264/30 |

*Primary Examiner*—Thomas P. Pavelko
*Attorney, Agent, or Firm*—A. W. Breiner

[57] ABSTRACT

A cavity in a heat-resistant structure, eg. of ferrous metal, is filled by fitting it with refractory brickwork. Instead of securing the brickwork with conventional cement, a flowable aluminous slag is produced in contact with the brickwork by exothermic reaction of a composition containing metallic aluminium and an oxidizing agent, preferably ferric oxide. The reaction, which may take place wholly or partially within the jointing space or spaces, is at such a temperature that the slag in said spaces is at least at a bond-forming temperature. Additives, eg. refractory particles, a flux, potassium nitrate or ferrous metal may be incorporated in the reaction mixture for control purposes subject to considerations described.

14 Claims, 9 Drawing Figures

REFRACTORY MATERIALS

SPECIFICATION OF THE INVENTION

The present invention relates to refractory materials and has as an object the provision of a method by which such materials can be installed or replaced in an improved manner.

In accordance with the present invention, there is provided a method of filling a cavity in a heat-resistant structure formed with a cavity to fill said cavity, said method comprising fitting the cavity with refractory brickwork whilst leaving at least one jointing space, forming a flowable aluminous slag in contact with the brickwork by an exothermic reaction of a composition containing metallic aluminum and an oxidising agent therefor, and allowing the slag to solidify within said jointing space said reaction reaching a temperature such that, before said solidification, the slag in the jointing space is at least at a bond-forming temperature.

An important application of the invention is to the filling of a cavity in the surface of a metal block, for example an ingot mould stool as used in the steel industry, by fitting the cavity with refractory bricks. Accordingly, there is further provided in accordance with the present invention, a method of filling a cavity in the surface of a metal block by fitting the cavity with refractory brickwork which substantially fills the cavity to the level of said surface, in which method the periphery of the brickwork is joined to the wall of the cavity by an aluminous slag produced in situ by an exothermic reaction of metallic aluminum with an oxidising agent reaching a temperature at which the liquid products of the reaction fix the brickwork firmly into position.

The refractory brickwork may be in the form of a number of separate bricks assembled within the cavity or in the form of a single large brick. The choice depends upon the size of the cavity, relative costs, the size or sizes of available bricks and the labor required in fitting. A large brick can often be shaped to fit the cavity reasonably easily by trimming with a hammer, no close mating fit or surface regularity being essential.

The bonding mechanism involved in the present method is not fully understood. It involves adhesion of the slag, in the solidified state, to the sides of the cavity. In some cases both sides are formed of refractory brick material, and in others one side is formed of the brick material and the opposite side by the material of the heat resistant structure, usually ferrous metal. Adhesion to the refractory material requires having the flowable slag at a bond-forming temperature and it is believed that solvent action is involved. In some cases minor erosion of the brickwork by the slag is descernible. In other cases, the bonding is too close to a surface effect for any visible localized modification of the brickwork to occur. It may be, though it must be emphasised that we do not wish to be bound by any theory, that a lowering of the fusion temperature of the refractory in the presence of the slag is involved. It is to be observed that slag solidified in contact with a refractory does not always bond thereto. Deliberate arrangement to reach a bond-forming temperature is essential.

The method of the invention is advantageous compared with conventional methods in which a conventional water-activated cement is used for securing the bricks together and to the wall of the cavity in that the filled block can be put into use without allowing time for cement to dry. Indeed, the block can be put into use as soon as the products of reaction have cooled sufficiently. Additionally, the wall of the cavity may be devoid over at least a part thereof of any keying formation. The aluminous slag forms an adequate bond with the metal and provides good retension of the brickwork in position whatever the shape of the metal at the wall. The successful use of conventional cements requires such a wall shape as to provide adequate keying for the brickwork if successful joints are to be obtained. In the case of stools and indeed of most components used in the severe conditions of the steel industry, the life of the brickwork is limited. Using a conventional cement, the brickwork can only be replaced for as long as erosion leaves the wall shape within satisfactory limits, and when these limits are exceeded the component must be discarded. Using the present method, erosion of the wall shape is of minor importance and indeed the method may be applied to many successive repairs of a component after it has reached the stage where conventional repair has become impracticable.

When the brickwork is not required for immediate use, it may be jointed using a conventional cement and the slag provided only for securing it to the metal.

In some cases the bricks may be packed tightly together and the slag provided only to secure the periphery of the brickwork to the wall of the cavity. In other cases the bricks may be spaced apart to provide joint spaces between them and further aluminous slag is similarly produced in the joint spaces.

Advantageously the exothermic reaction may be carried out in the presence of an alkali metal salt which promotes fusion of the adjacent brick surfaces. A preferred alkali metal salt is potassium nitrate. Sodium nitrate may be used but precautions must be taken to avoid deleterious effects produced by deliquesence.

The preferred oxidising agent for the aluminum is ferric oxide. A supplementary oxidising agent, eg. manganese dioxide may be employed if desired.

Metallic iron is produced as a reaction product when ferric oxide is employed. It settles to the lowermost part of the joint and though it may adhere to the ferrous metal of the block it does not contribute essentially to the efficacy of the jointing produced by the slag. Its presence is harmless in a first repair.

If desired, a particulate refractory material, for example crushed refractory brick, may be incorporated in the reaction mixture for reasons of economy, to improve the erosion resistance of the slag, or to moderate the exothermic reaction, or to reduce fume evolution.

Up to 10% of a flux, e.g. calcium fluoride may be added if desired. Manganese dioxide may be added, as an additional oxidising agent in an amount of up to 3%. These percentages are based on the total weight of the composition.

The compositions of specific reaction mixtures which have been employed successfully are shown in the Table I below, where, as in later Tables, the figures indicate the amounts of the components in percentages by weight based upon the total weight of the compositions. The last column shows the preferred ranges (expressed on the same basis) of the amounts in which the components are employed in the practice of the invention.

TABLE I

| | | | | | | | | |
|---|---|---|---|---|---|---|---|---|
| Aluminum Powder | 18.9 | 18.0 | 18.0 | 18.0 | 18.0 | 18.0 | 18.0 | 14 to 25(a) |
| Iron Oxide | 62.3 | 63.0 | 63.0 | 53.3 | 59.4 | 53.3 | 59.4 | 45 to 82(b) |
| Refractory Particles | 18.9 | 11.0 | 16.0 | 28.7 | 22.6 | 20.7 | 19.6 | 0 to 40 |
| Fluorspar (flux) | — | 5.0 | — | — | — | 5.0 | — | 0 to 10 |
| Potassium Nitrate | — | 3.0 | 3.0 | — | 3.0 | 3.0 | 3.0 | 0 to 6 |

(a)17.0 to 18.0 preferred
(b)more preferably 45 to 75

The formulation of an optimum reaction mixture for a particular purpose depends upon circumstances, and, for this reason, the following guidelines are given:

(1) The optimum percentage of aluminum powder is normally 17–18%. A higher percentage is preferable in some cases but involves increased costs. Costs can be reduced by using less than 17% but ignition and flow problems must then be tolerated. For most purposes, such reduction is not recommended.

(2) Increasing the amount of potassium nitrate increases the amount of fumes evolved from the reacting mixture and changes of composition requiring an increase of the potassium nitrate content are desirably avoided, especially in a normal workshop.

(3) The refractory particles tend to slow the rate of reaction, reduce the temperature achieved and reduce the amount of fumes. A low rate of reaction and reduced temperature are attractive for reasons of safety and comfort, but they should not be made so low that the bonding of the brickwork is insufficiently effective. The size of a space in which the composition is reacted and the thermal insulating effect of surrounding materials affect the temperature achieved. The effect of the refractory particles depends upon their size; freedom from fines is desirable, the presence of particles finer than 1 mm sieve size being preferably avoided.

(4) Iron oxide present in excess over the stoichiometric amount acts as a flux. Mill scale is the form of iron oxide normally employed.

(5) The iron produced by the reaction assists the slag in fixing the brickwork together and in fixing the brickwork to the metal, however, its contribution is not essential. The metal is in one way an unwanted byproduct which can interfere with future repairs because of difficulty of removal. By diluting the reactive components, the refractory component reduces the amount of iron produced and so assists with this difficulty. Additionally, the slag phase, which acts as a cement for the brickwork, is increased in volume and, therefore, in its cementing effect by the presence of the refractory. Increasing the slag volume relative to the iron produced helps to minimise the amount of iron produced.

(6) The physical properties of the slag phase are favourably affected by the contained refractory. In applications where the brickwork is subjected to erosion by molten steel or otherwise Reference is made under (3) above to the presence of refractory particles tending to slow the rate of reaction and reducing the temperature achieved. Ferrous metal in particulate form eg. steel chips, or swarf or mill borings from cast iron, may be used with similar effect in cases where the presence of additional metallic iron in the repair can be tolerated. Here consideration has to be given to its effect on future repairs. Its accumulation can reduce the depth available for the aluminous slag and can interfere with the fitting of brickwork.

Examples of compositions containing steel chips are given in the following Table II in which the figures are percentages by weight based on the total weight of the compositions.

TABLE II

| | | | |
|---|---|---|---|
| Aluminum | 18 | 18 | 18 |
| Iron Oxide | 63 | 63 | 63 |
| Refractory Particles | 8 | 0 | 0 |
| Fluorspar | 2 | 2 | 2 |
| Potassium Nitrate | 0 | 0 | 2 |
| Steel Chips | 9 | 17 | 15 |

Examples of compositions which were found to be unsatisfactory in use are given below in Table III.

TABLE III

| | A | B | C |
|---|---|---|---|
| Aluminum | 14 | 25 | 25 |
| Iron Oxide | 60 | 75 | 73 |
| Refractory Particles | 21 | — | — |
| Fluorspar | 3 | — | 2 |
| Potassium Nitrate | 2 | — | — |

Composition A was difficult to ignite and the slag was too viscous to flow into spaces between and around bricks. The potassium nitrate and fluorspar were included to facilitate ignition and increase fluidity but had insufficient effect.

Composition B (plain Thermit close to stoichemetric) ignited easily but burnt too fast with too much fuming. It was judged dangerous for operatives to use. The high alumina slag was insufficiently fluid and too brittle.

Composition C had improved slag flowability because of the Fluorspar—however, the other problems of Composition B remained.

Guided by the examples of compositions given in Tables I, II & III, and the comments thereupon, it is considered that those skilled in the art will be able to select compositions suited to particular circumstances, if necessary after simple routine experimentation.

As well as being useful in the repair of stools the invention is applicable to the installation or repair of brickwork for high temperature applications generally. Thus the cavity may be a cavity, eg. produced by wear, in the refractory lining of an open-hearth furnace. Again the cavity may be the brick-retaining part, or a defect in brickwork installed in the brick-retaining part, of a furnace door, eg. the door of an open-hearth furnace. Another application is to the fitting or repair of the brickwork of the ladle bottom of a ladle of the type used for pouring in the casting of ferrous metals. In its application to the repair of brickwork the invention is of interest because the repaired brickwork may be put into service quickly after the repair operation. The absence of any necessity to work on the brickwork to provide keying, even though this may be a simple operation, is attractive for economic reasons.

The following description in which reference is made to the accompanying diagrammatic drawings is given in order to illustrate the invention. In the drawings.

Figure 1A:
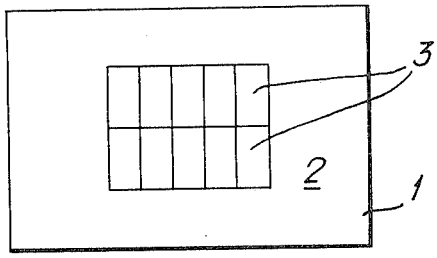
FIG. 1 shows a cast iron stool having a cavity filled with brickwork in the conventional manner at A, B & E and by the method of the present invention at C and D.
Figure 1B:
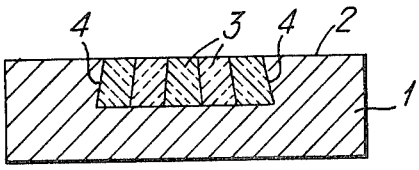
Figure 1C:
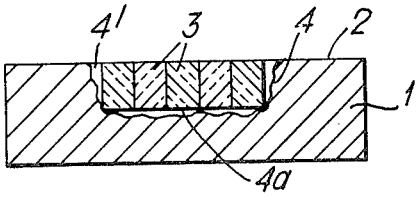
Figure 1D:
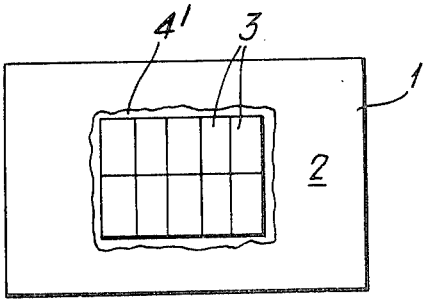
Figure 1E:
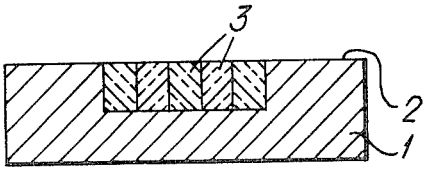

In FIG. 1 a cast iron stool 1 for an ingot mould is shown, in plan A and in cross section at B, having a cavity filled to the level of top surface 2 with refractory brickwork 3 cemented in position by conventional water-activated cement, not shown. As will be seen at B, the wall 4 of the cavity is usually inclined to give the cavity a re-entrant shape which keys the brickwork in position in the absence of adhesion to the cast iron. E is similar to B but a vertical sided cavity is used.

The brickwork may be replaced from time to time as required but the wall of the cavity eventually becomes eroded to an extent such that the stool must be re-machined or scrapped.

As shown in cross-section at C and D considerable erosion of the wall 4 has taken place giving a sloping, non- re-entrant inclination opening to a gap 4' of irregular annular peripheral shape around the brickwork at the level of surface 2. Erosion of the bottom has also occurred as indicated at 4*a*. Using conventional methods of fitting the brickwork 3, the plate 1 would have had to be discarded long before reaching the condition shown at C and D. New brickwork can however be fitted by packing tightly with refractory bricks and introducing a slag-producing composition through gap 4' and reacting it in situ according to the method of the present invention. The slag forms a satisfactory adhesive bond with the metal and the bricks (which fuse locally) and no geometric keying action is required.

Figure 2:
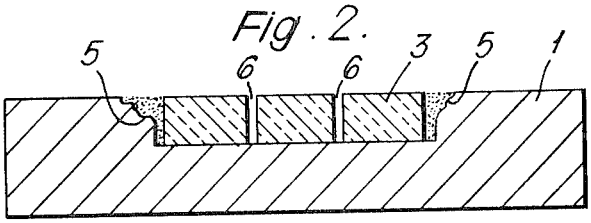
FIGS. 2 and 3 are cross sections showing similar stools filled with brickwork by the method of the present invention.

FIG. 2 shows a block 1 with the shoulders of the cavity worn at 5. The cavity is fitted with brickwork 3 having joints 6 formed by conventional water activated cement. The peripheral space between the brickwork and the wall of the cavity in the plate 1 is filled with a slag by the method of the invention. Satisfactory bonding of the brickwork to the wall of the cavity is obtained.

Figure 3:
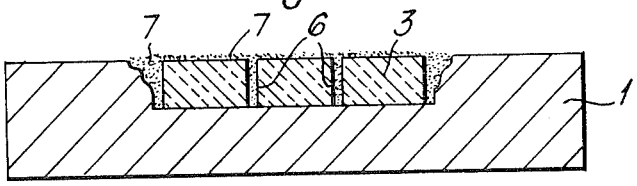

FIG. 3 shows a modification of FIG. 2. In this case the joints 6 as well as the peripheral space are filled with slag by the present method. This is achieved by brushing the reaction mixture 7 over the brickwork until the joints are filled. The heat generated by the reaction mixture fuses the faces of the bricks in contact therewith. The liquid products of the reaction run under and around the brickwork filling any voids present, the liquid product occupies less space than the solid reaction product and it is therefore usually desirable to feed more reaction product to compensate for these effects. Feeding of the fresh reaction product must be carried out when the products of the reaction are still hot enough to ignite the fresh material. Feeding of the product is continued until the cavity is completely filled. On the setting of the slag by solidification, the slag bonds to the bricks at the joints and to the underlying metal of the block. An especially strong structure results and the repaired block is ready for immediate re-use.

Figure 4:
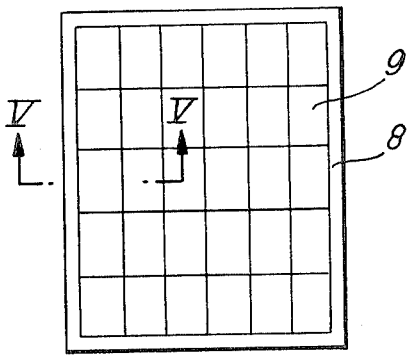
FIG. 4 shows a furnace door in elevation.
Figure 5:
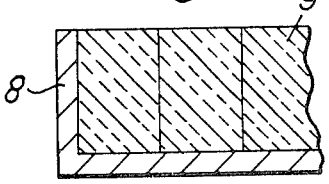
FIG. 5 is a cross section taken along V—V of FIG. 4.
Figure 6:
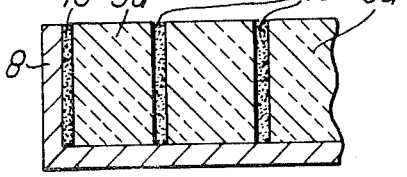
FIG. 6 shows the application of the invention to the door of FIGS. 5 & 6.

FIG. 4 shows a furnace door having a steel frame 8 fitted with a firebrick lining 9. The bricks of the lining are normally secured tightly in position (FIG. 5) with a water-activated cement. In the application of the invention, the firebricks 9*a* are positioned with gaps therebetween and between the outer firebricks and the frame 8. A composition 10 as hereinbefore described is introduced as hereinbefore described into the resulting gaps and fired in situ. When the resulting aluminous slag has solidified by cooling, the door is ready for immediate use. The slag cements the bricks together and to the frame, producing a strong bond without the requirement for a hardening period.

Linings for other parts of furnaces may be fitted to the supporting steelwork in essentially the same manner.

Figure 7:
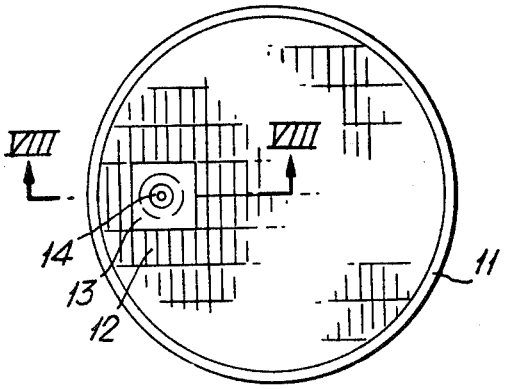
FIG. 7 shows a ladle in plan.
Figure 8:
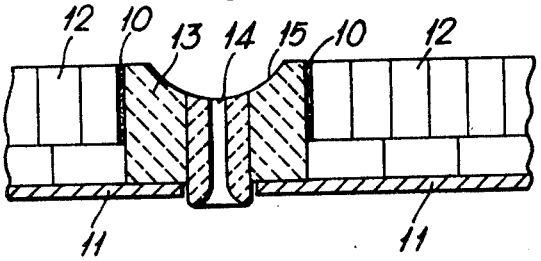
FIG. 8 is a cross section taken along XIII—XIII of FIG. 7.

FIG. 7 shows a ladle in plan and FIG. 8 shows part thereof in cross section taken along VIII—VIII of FIG. 7. The ladle has a steel shell 11, a bottom lining 12 of refractory brickwork, a wellblock 13 and a nozzle 14, the concave upper surface 15 of which is used in conjunction with a stopper (not shown).

The life of the well block 13 is frequently short compared with that of the lining 12.

To fit a replacement well block, a mixture 10 as described herein, is fired in the space between the outer periphery of the well block and the surrounding brickwork. If necessary, the brickwork is trimmed back to provide the requisite space for the mixture. The ladle is ready for use as soon as the aluminous slag has solidified.

Figure 9:
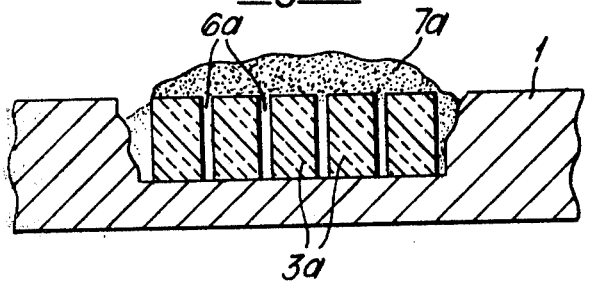
FIG. 9 is a cross-section of a stool filled with brickwork by modification to the method of the present invention.

FIG. 9 shows a modification of the method of FIG. 3 which is preferable when, for example, the bricks 3*a* are positioned on end and the joints 6*a* therefore relatively deep. A pile 7*a* is heaped upon the brickwork. In addition the joints may be filled with the reaction mixture. The pile is ignited so that the slag runs into the joints of the brickwork and the space between the brickwork and the surrounding (eroded) wall of the block 1. The residue from the reaction tends to enter the joints to compensate for shrinkage of the fill. Any excess runs off the top of the structure and may be assisted by sweeping with a suitable heat-proof tool. A composition with a low yield of iron is preferred for this form of the method to minimize having a localized excess of iron in the repair.

It will be understood that the foregoing description is given for purposes of illustration only and that various departures may be made from embodiments specifically described without departing from the spirit and scope of the invention.

We claim:

1. A method of treating a ferrous metal structure formed with a cavity by fitting the cavity with refractory brickwork which substantially fills the cavity to the level of said surface, but has a periphery which defines a gap between the brickwork and the ferrous metal of the structure, in which method the periphery of the brickwork is joined to the ferrous metal structure by an aluminous slag produced in contact with the brickwork in the gap by an exothermic reaction of a composition containing from about 14–25 percent by weight metallic aluminum; 45–82 percent by weight oxidizing agent for said aluminum; 0–40 percent by weight particulate refractory material; 0–10 percent by weight flux and 0–6 percent by weight alkali metal salt; said proportions being adjusted to provide a flowable material which will flow into spaces and gaps, and allowing said slag to solidify within said gap, said reaction reaching a temperature such that, before said solidification, the slag in the jointing space is at least at a bond-forming temperature for the brickwork and the ferrous metal of the structure.

2. A method according to claim 1 in which the cavity has a bounding wall which is devoid, over at least a part, thereof of any keying formation.

3. A method according to claim 1 in which the brickwork is formed of bricks spaced apart to provide joint spaces between them and further aluminous slag is similarly produced in the joint spaces.

4. A method according to claim 1 in which the brickwork is in the form of a monolithic block.

5. A method according to claim 1 in which the cavity is a cavity in the refractory lining of a furnace.

6. A method according to claim 1 in which the cavity is the brick-retaining part of a furnace door.

7. A method according to claim 1 in which the brickwork has an exposed outer face, the composition is formed into a pile upon said outer face, the exothermic reaction is initiated in said pile and slag produced by the reaction runs from the reacting pile into said jointing space.

8. A method according to claim 1 wherein the metallic aluminum is present in an amount of from 17 to 18 percent, and said oxidizing agent is present in an amount of from 45 to 75 percent.

9. A method according to claim 1 in which the oxidising agent is ferric oxide.

10. A method according to claim 9 in which manganese dioxide is present in the composition as a supplementary oxidising agent.

11. A method according to claim 1 in which a particulate refractory material is present.

12. A method according to claim 11 in which the particulate refractory material is crushed refractory brick.

13. A method according to claim 1 in which an alkali metal salt is present in an amount up to 6 percent of claim 2.

14. A method according to claim 13 in which the alkali metal salt is potassium nitrate.

* * * * *